United States Patent [19]

Grant

[11] Patent Number: 4,986,563

[45] Date of Patent: Jan. 22, 1991

[54] EMERGENCY HAND TRUCK

[76] Inventor: Fred W. Grant, 3177 Terrace Ct., Apt. H, Norcross, Ga. 30092

[21] Appl. No.: 382,981

[22] Filed: Jul. 21, 1989

[51] Int. Cl.[5] ..... A61G 1/02

[52] U.S. Cl. ..... 280/640; 5/82 R; 280/47.11; 296/20

[58] Field of Search ..... 280/640, 641, 47.11, 280/47.34, 47.371, 87.1, 87.41, 47.25, 655.1, 97; 296/20, 14; 5/82 R

[56] References Cited

U.S. PATENT DOCUMENTS

| | | | |
|---|---|---|---|
| 1,570,787 | 1/1926 | Schroeder | 280/87.041 |
| 2,142,215 | 1/1939 | Schmidt | 296/20 |
| 2,228,012 | 1/1941 | MacKenzie | 5/82 R |
| 2,350,062 | 5/1944 | Mosier | 280/87.01 |
| 2,400,426 | 5/1946 | Liptay et al. | 5/82 |
| 3,740,778 | 6/1973 | Jordan | 5/82 R |
| 4,695,072 | 9/1987 | Brooks | 280/47.25 |

FOREIGN PATENT DOCUMENTS

| | | | |
|---|---|---|---|
| 2251461 | 4/1974 | Fed. Rep. of Germany | 5/82 R |
| 1282419 | 12/1961 | France | 5/82 |

*Primary Examiner*—David M. Mitchell
*Attorney, Agent, or Firm*—Thomas & Kerr

[57] ABSTRACT

An emergency hand truck for removing injured athletes from a playing field has an approximately horizontally extending frame and a bed suspended from the frame, with a portion of the bed sloped upwardly from the rear to the approximate center of the truck to support the buttock and thighs of a person and sloped downwardly from the approximate center to the front of the truck to support the calves and feet of a person. Wheels are provided to support the truck at the front and rear, the front wheels being swiveled for steering the truck. A back support is pivotably mounted to the rear of the frame and is movable between a horizontal attitude lying over the bed to a sloped position for supporting the abdomen of a person in an inclined position.

9 Claims, 3 Drawing Sheets

EMERGENCY HAND TRUCK

FIELD OF THE INVENTION

This invention relates generally to hand trucks, and, more particularly, to hand trucks for emergency use, such as transporting an injured athlete from the field of play.

BACKGROUND OF THE INVENTION

In most types of sports, such as football, track, soccer and the like, the athletes are subject to injuries of varying degrees of seriousness, from pulled muscles to broken bones or concussions. In all cases where trauma has occurred, athletic trainers and doctors are agreed that even a mild injury can be seriously aggravated by the athlete's attempting to walk off of the field, either alone or escorted. Even a pulled muscle for a track athlete can be seriously aggravated by walking or limping, thereby causing further damage and increasing materially his recovery time. It is further agreed among these experts that the injured player should be substantially immobilized in, for example, a fixed position while being removed from the field of play.

Heretofore, where a player has been injured, as in a football game, for example, generally he is encouraged to walk off of the field, usually with the help of other players or trainers. Where the trauma is more serious, a stretcher or litter, or a gurney, which is simply a wheeled stretcher, is used to transport the player off of the field. In the case of the stretcher or litter, several people are required to transport it, and, where the player is large, a common occurrence among football players, transporting him while keeping him on the litter is difficult. In the case of the gurney, the player must lie prone thereon, and generally must be held in place such as by strapping to prevent his rolling or falling off. This is especially true if, as is often the case, the gurney has a high center of gravity, which tends to make it unstable.

In addition to the foregoing, it is generally agreed among experts in the athletic trauma field that there is an optimum position or attitude that the injured party should be in while being transported, and the prone position, which is common to litters, stretchers, and gurneys is actually undesirable in most cases and for most types of trauma.

SUMMARY OF THE INVENTION

The present invention, in a preferred embodiment thereof, is a wheeled hand towable truck comprising a tubular frame member from which depend an array of tubular support members of varying length, the members on the ends of the array being the longest and the member in the approximate center of the array being the shortest. Attached to the support member at one end of the truck is a wheel and axle assembly, and attached to the other end of the truck is a steerable wheel assembly adapted to swivel about a vertical axis. A handle is pivotally attached to the swivelable wheel assembly for pushing, pulling and steering the truck.

A plurality of support members extend longitudinally of the truck and are attached to the depending support members to define a bed which slopes upward from the rear of the truck and from a point below the longitudinal support members to the approximate center of the bed, and downward from the approximate center to the front of the truck. A suitable surface overlays the longitudinal support members for affording a comfortable supporting bed surface for the party to be transported.

A back member comprising a frame and support members is pivotally attached at the rear of the truck so that it has a first, stored position lying flat along the top of the truck, and a second, operating position where it forms a preferred angle with the adjacent bed surface. The back frame is adapted to be locked in its operating position and unlocked by a simple action for placing in its stored position.

Accordingly, it is an object of the apparatus of the present invention to provide safe transport for an injured party.

It is another object of the present invention to maintain the injured party in an optimum position while being transported.

It is still another object of the present invention to maintain the injured party securely in position on the apparatus of the invention while being transported, with support for all parts of the body.

The objects, features and advantages of the present invention will become more readily apparent from the following detailed description, read in conjunction with the accompanying drawings.

DETAILED DESCRIPTION

Figure 1:
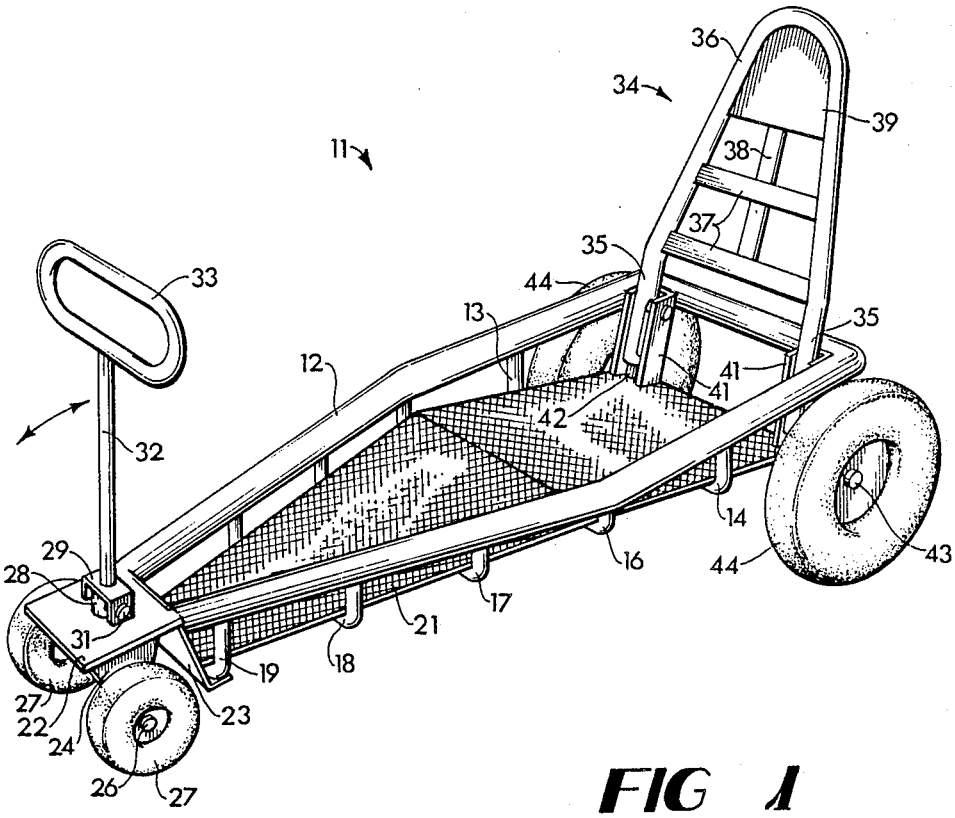
FIG. 1 is a perspective view of the emergency hand truck of the present invention.
Figure 2:
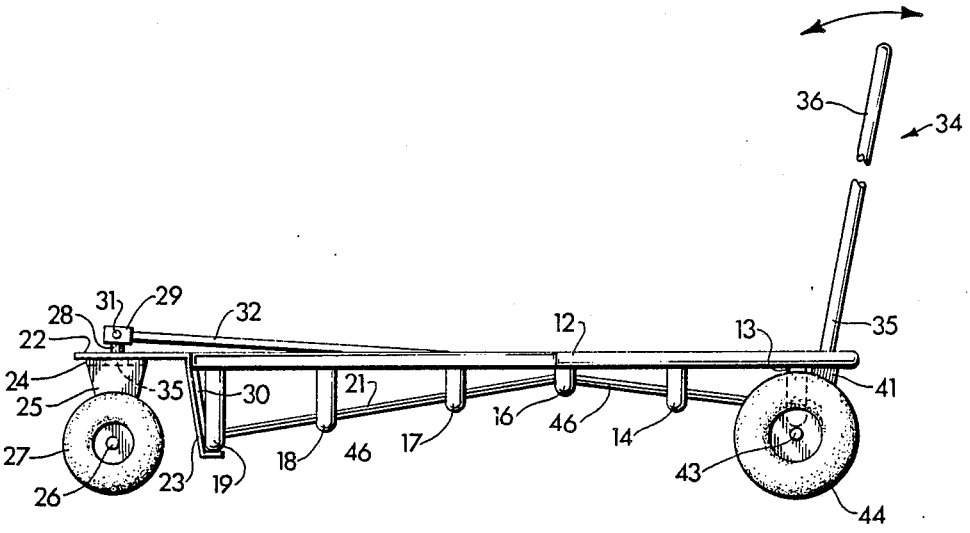
FIG. 2 is a side elevational view of the truck of the invention.

Referring now in more detail to the drawings, in which like numerals indicate like parts throughout the several views, the emergency hand truck of the present invention, a preferred embodiment 11 of which is depicted in FIG. 1, comprises a tubular frame 12 of, for example, sixteen gauge hollow steel tubing, to which are attached, as by welding, an array of tubular U-shaped support members 13, 14, 16, 17, 18, and 19. As can be seen in FIG. 2, the depending arms of support member 13, the rearmost support, are longer than the depending arms of member 14, which in turn are longer than those of member 16, which is located approximately at the center of the array, which is the approximate mid-point of the length of the truck 11. Similarly, the arms of support member 19, which is the frontmost member of the array, are longer than the corresponding arms of member 18, which in turn are longer than the arms of member 17. The arms of member 17 are, in turn, longer than the depending arms of member 16. From the foregoing, it can be seen that the transverse arms of members 13, 14 and 16 define a plane which slopes upwardly from the rear of truck 11 to the approximate center thereof, and the transverse arms of members 16, 17, 18, and 19 define a plane which slopes downwardly from the approximate center of the truck to the front thereof. As will be discussed more fully hereinafter, the angle of slope of this downwardly sloping plane is greater than the angle of slope of the upwardly sloping plane.

Figure 3:
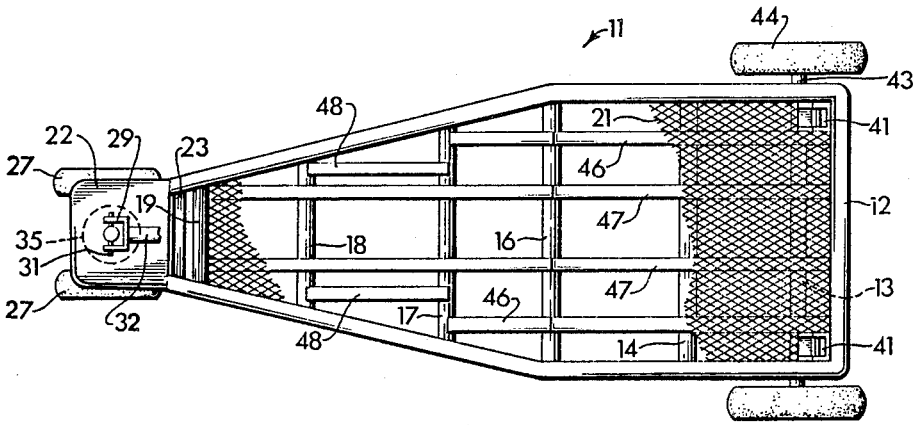
FIG. 3 is a plan view of the bed of the truck of the invention, with certain elements thereof removed for clarity.

A bed surface 21 of an open mesh material, such as, for example, expanded metal, overlays the support members in a manner which will be discussed more fully in connection with FIGS. 2 and 3, and constitutes the body support for the person being transported.

At the front of the truck 11 is mounted a plate 22 having a depending portion 23, which is affixed to frame 12 as by welding, and to support member 19, also by welding. Plate 22 has swivelly mounted on the underside thereof an axle support bracket 24, the depending ears 25 of which support an axle 26 to which are mounted a pair of wheels 27, 27. Preferably wheels 27, 27 are ball bearing mounted on axle 26, and are equipped with balloon type pneumatic tires. The swivel mounting of bracket 24 is better seen in FIG. 2, and will be discussed more fully in connection with that figure. Extending upwardly from bracket 24, to which it is affixed, through a hole in plate 22, is a pin 28, to which is mounted, by means of a clevis 29 and pin 31, a handle 32, the upper end of which is terminated in a suitable hand grip 33. As can be seen, handle 32 can be pivoted forward and backward, as indicated by the arrows, and turning the handle about the vertical axis defined by pin 28 causes the wheels 27, 27 to turn. Thus the wheel and handle assembly affords a means for pulling or pushing truck 11, and for guiding it. Furthermore, handle 32, by virtue of the clevis and pin mounting, can be rotated back and down to a storage position, as best seen in FIG. 2.

At the rear of truck 11 is mounted a back member 34 having a hollow tubular frame 36 having first and second arms 35, 35 to which are welded strengthening and support members 37 and 38 and a headrest plate 39. Member 34 is shown in its upright, operative position, in which it is supported and locked by locking mechanism 41, which will be explained more fully in the discussion of FIG. 4. Member 34 can be unlocked and rotated forward into its stored position, not shown, by the simple expedient of being lifted clear of locking pins 42 in mechanism 41, and being rotated forward to be against bed 21. While not shown, it is to be understood that suitable cushioning means many be attached to member 34 for the added comfort of the injured person.

A rear axle 43 has mounted thereon wheels 44, preferably equipped with balloon pneumatic tires. Axle 43 is mounted on the bottom of support member 13 by welding or other suitable means, although other forms of mounting axle 43 may be used, especially where it is desired to utilize springs or shock absorbers.

The embodiment of the invention shown in FIG. 1 has been described thus far as being fabricated from steel with the various elements joined by welding, for example. It is to be understood that other types of materials may be used, thus the entire truck 11 may be made, for example, from a plastic of sufficient strength to handle the anticipate loads, which may be molded or glued together to form the truck 11. It is not intended that the invention as described be limited to steel components, the various other suitable materials being well within the scope of the invention.

In FIG. 2 certain of the details of truck 11 are more clearly shown. It can be seen, for example, that the depending portion 23 of plate 22 terminates in a lip passing under support member 19, and that a strengthening member 30 is provided. The swivel arrangement 35 for bracket 24 is shown in dashed lines, and is of conventional, known construction. It is desirable, although not necessary, that the swivel be of ball bearings to facilitate turning the bracket 24 and wheels 27. In addition, handle 32 is shown in its stored position.

Figure 4:
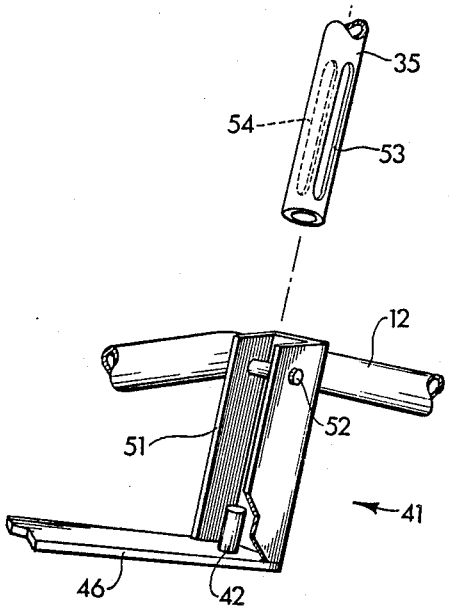
FIG. 4 is an exploded view of the details of the back locking mechanism, shown in perspective.

A plurality of flat support members 46, 46 are mounted on and attached to support members 13, 14, 16, 17, 18, and 19 for strengthening the structure and for furnishing continuous support for bed 21. The support members are shown more clearly in FIG. 3, which is a plan view of truck with back member 34 omitted, for clarity. In addition to longitudinal flat support members 46, 46, there are provided support members 47, 47 and 48, 48 as shown. These support members, which may, for example, comprise three-sixteenths of an inch by one and one-half inch steel slats supply ample support for bed 21, while affording a degree of resiliency for additional patient comfort. Locking and support mechanism 41 may be attached, as by welding, to support member 13, as shown in FIG. 3 or to the rear ends of support members 46, 46, as shown in FIG. 4. Bed 21 is preferably cut out to clear members 41.

Figure 5A:
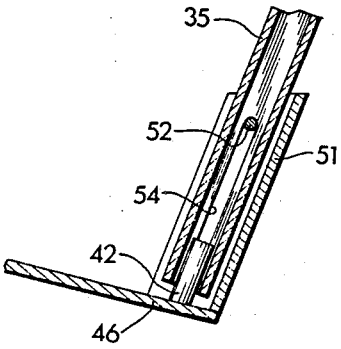
FIG. 5A and 5B are partial cutaway elevational views of the back frame 36 in the lock position and the unlocked, storage position, respectively.
Figure 5B:
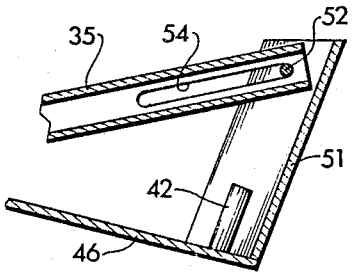

FIG. 4 depicts details of the locking mechanism 41 for hollow back frame 36 in which a U-shaped bracket 51 is shown welded or otherwise attached to member 46. Arm 35 has a pair of longitudinally extending diametrically opposed slots 53 and 54 extending upwardly from adjacent the end thereof and a pin 52 mounted in bracket 51, as shown, passes through the slots 53 and 54. Frame 36 is adapted to fit over a pin 42, which holds the back 34 in place in its operative position, as best seen in FIG. 5A. When the truck 11 is not in use, back 34 is placed in its storage position by the operator lifting up on frame 36 until the bottom thereof clears pin 42, and then rotating the back 34 forward to its storage position, as best seen in FIG. 5B.

The invention as just described comprises an emergency hand truck in which a disabled patient sits down within the frame of the truck thereby being protected and laterally supported within the truck, while his back rests against an angled back support, in which the angle is preferably in the range of 100° to 120° to the horizontal. The patient's buttock and the upper parts of his legs, i.e., thighs, are supported by the bed of the truck angling upwardly from the back support and the backs of his knees are supported at the transition of the bed from the upward angle (taken from the rear of the truck) to the downward angle, which downward angled portion of the bed supports his calves and feet. The back support allows the abdomen, head and arms to be supported at a sloped or reclined attitude so as to minimize the tension on the calves and thighs of the patient. Thus, virtually all parts of the body are well supported at optimum angles and positions, while the body is restrained from lateral movement. Various types of cushions and pillows, which have not been shown, may be used to ease further the patient's discomfort.

The bed surface 21 of the truck lies below the frame 12, producing a low center of gravity of the truck, which, in conjunction with the front wheel location, reduces any tendency of the truck to tip over when being loaded or operated.

An added benefit of the unique structure of the present invention is its versatility. Thus, it is possible to use the truck as an equipment transporter for example, either with the back in its upright position or in its stowed position.

The features and principles of the present invention have been illustrated in the foregoing description of a preferred embodiment thereof. It will be apparent to workers in the art that numerous changes or alterations may occur thereto without departure from the spirit and scope of the invention, such as, for example, providing a motor or other propulsion means for the truck. It would further be obvious to replace the wheels of the truck with skis, for example, for use on snow surfaces.

I claim:

1. An emergency hand truck comprising, in combination an elongated frame member having a front portion, a rear portion, and opposed side members extending along the length of said frame member, a support bed depending from said frame member, said support bed comprising an array of transverse support members arranged along the length of said frame member and each extending across said frame member and attached at its end portions to said opposed side members and depending from said opposed side members, individual ones of said transverse support members extending at progressively greater distances from said frame member along the length of said frame member from an intermediate position of said frame member toward the front portion and toward the rear portion of said frame member a bed surface overlying and supported by said transverse support members, said bed surface extending at downwardly sloped angles from the intermediate position of said frame member toward the front portion and toward the rear portion of said frame member an adjustable back member mounted adjacent the rear of said truck, first wheel means mounted at the rear portion of said frame member outside of said frame member at the sides thereof, and extending above said frame member, second wheel means swivelly mounted to the front portion of said frame member at a location forward of said support bed, and means for steering said truck by swivelling said second wheel means.

2. An emergency truck as claimed in claim 1 wherein said back member has an operative position and storage position, and further including means for locking said back member in its operative position.

3. An emergency hand truck comprising in combination an elongated frame member having a front portion, a rear portion and opposed side members extending along the length of said frame member, an array of transverse support members depending from said frame member, individual ones of said transverse support members depending at different distances from said frame member, each succeeding transverse support member from the rear portion of said frame member to the approximate center of the array depending closer to the frame than the preceding transverse support member, and each succeeding transverse support member from the approximate center of the array to the front portion of said frame member depending at a farther distance from the frame member, a bed surface overlying and supported by said transverse support members, an adjustable back member mounted adjacent the rear of said frame member, means for supporting and facilitating movement of said truck over the surface upon which it rests, said means comprising a first pair of wheels mounted on opposite sides of said frame member at the rear thereof and a second pair of wheels at the front of said frame member, said second pair of wheels being swivelly mounted to said truck whereby said truck can be steered, and a handle member pivotally attached to said second pair of wheels for permitting said handle member to be folded down toward the bed of said truck.

4. An emergency truck as claimed in claim 3 wherein said bed surface comprises an open mesh material.

5. An emergency truck as claimed in claim 3 wherein said frame member, said support members, and said back member comprise hollow cylindrical tubular material.

6. An emergency truck as claimed in claim 5 wherein said tubular material is steel.

7. An emergency truck as claimed in claim 5 wherein said tubular material is plastic.

8. In combination with an emergency truck having a back portion which has an operative position and further having a frame and a bed, with the bed extending below the frame and along the length of the truck from the rear thereof to the front, the back portion comprising first and second hollow cylindrical arms having open lower ends a locking mechanism for holding the back portion in its operative position comprising a pair of diametrically opposed slots in each of said arms adjacent the said lower ends thereof, a pair of U-shaped brackets opening toward the front of said truck and having first and second legs mounted to said truck at each side thereof and extending upwardly therefrom and having a distal end, each of said brackets being adapted to receive one of said first and second arms, a locking pin member mounted to said truck and extending upwardly with each of said brackets, each of said locking pins being adapted to fit within the open end of one of said arms, and a pivot pin extending between said first and second legs of each bracket through said diametrically opposed slots.

9. The combination as claimed in claim 8 wherein said U-shaped brackets and said pin members are mounted to the bed of said truck.

* * * * *